United States Patent [19]

Griffith

[11] Patent Number: 4,664,255

[45] Date of Patent: May 12, 1987

[54] CARRIER FOR EMPTY BEVERAGE CANS

[76] Inventor: Dwight N. Griffith, 2949 S. 39 Rd., Cadillac, Mich. 49601

[21] Appl. No.: 858,032

[22] Filed: May 1, 1986

[51] Int. Cl.[4] ..... B65D 67/02; B65D 85/62

[52] U.S. Cl. ..... 206/162; 206/427; 206/493; 211/71; 294/87.1; 294/158; 294/165

[58] Field of Search ..... 206/139, 142, 143, 147, 206/145, 159, 160, 162, 192, 193, 201, 427, 430, 431, 429, 443, 446, 493, 495; 211/71, 72, 74; 294/26, 28, 87.1, 87.2, 87.28, 148, 158, 159, 163, 165

[56] References Cited

U.S. PATENT DOCUMENTS

| | | | |
|---|---|---|---|
| 0,896,131 | 8/1908 | Marsh | 206/493 |
| 2,071,944 | 2/1937 | Hoffman | 211/74 |
| 2,575,809 | 11/1951 | Hankins | 211/71 |
| 2,747,914 | 5/1956 | Lyons | 294/87.1 |
| 3,727,752 | 4/1973 | Poupitch | 206/159 |
| 3,978,985 | 9/1976 | Zinnbauer | 206/493 |
| 4,106,629 | 8/1978 | Doyle et al. | 211/71 |
| 4,136,772 | 1/1979 | Mascia et al. | 206/199 |
| 4,182,455 | 1/1980 | Zurawin | 211/71 |
| 4,191,290 | 3/1980 | Suffern | 206/427 |
| 4,236,638 | 12/1980 | Griffith | 206/493 |

*Primary Examiner*—William I. Price
*Assistant Examiner*—Jimmy G. Foster
*Attorney, Agent, or Firm*—Krass & Young

[57] ABSTRACT

A carrier for empty beverage cans comprising a carrier body having compressible projections extending from a working surface thereof to be thrust through the opening of the empty cans and having stripping means movably secured to the carrier body to allow convenient removal of cans from the projections. Handles permit the body to be hung against a wall and to conveniently move the stripper means from the carrier body. Projections of specific shape are disclosed.

10 Claims, 3 Drawing Figures

CARRIER FOR EMPTY BEVERAGE CANS

INTRODUCTION

This invention relates to a device for storing and transporting empty beverage cans, and particularly to a device from which the cans are easily and quickly removed.

BACKGROUND OF THE INVENTION

Returnable beverage cans are commonly accumulated in receptacles such as boxes or bags for return to the place of purchase. This approach has a number of drawbacks including unsightliness and inefficient, nonproductive use of space. In addition, the use of boxes or bags makes it difficult to keep track of the number of accumulated cans and the correct amount of deposit credit which should be received upon return.

The prior art includes two devices which address the problem of empty beverage can accumulation. The first is shown in U.S. Pat. No. 4,136,772 to comprise a rigid plastic sheet with openings to receive and hold can tops. The second is shown in U.S. Pat. No. 4,236,638 to comprise a board or sheet having bayonet-type projections which grip the cans by entering into and gripping the sides of the openings in the tops of the cans.

Neither of these prior art devices provides for the quick and convenient removal of the cans from the carrier; i.e., each can must be individually detached from the carrier at the return depot.

BRIEF SUMMARY OF THE INVENTION

It is the object of this invention to provide an empty beverage can storage and carrier device for neatly and conveniently storing and transporting empty beverage cans, for keeping track of the number of accumulated cans, and for quickly and easily removing the arrayed empty cans from the carrier.

This is accomplished through the provision of a multi-can carrier adapted to receive and hold cans, preferably but not necessarily in the manner of my previous U.S. Pat. No. 4,236,638, and which further includes a stripper member pivotally connected to the carrier and normally lying between the carrier and the cans so that pivoting the stripper relative to the carrier pushes all the cans off of or away from the carrier in a progression fashion.

The device is preferably constructed of a plastic material which can be injection molded in one piece and the stripper member is movably secured to the carrier body with a living hinge. The preferred embodiment also includes a handle on both the carrier body and the stripper which not only allows the carrier to hand against a wall but also provides a convenient means for the operator to pivot the stripper plane relative to the body.

DETAILED DESCRIPTION OF THE ILLUSTRATIVE EMBODIMENT

Figure 1:
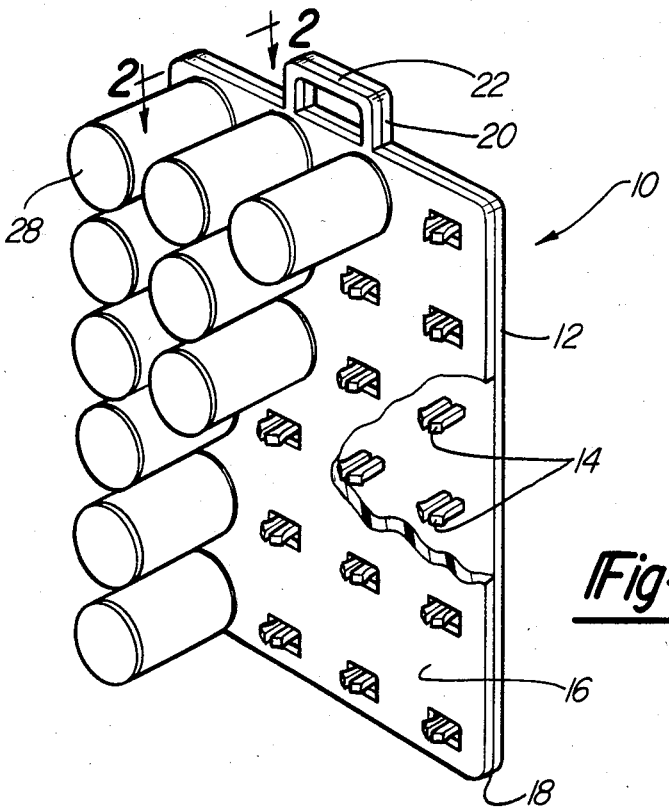
FIG. 1 is a perspective view of a can carrier with several empty beverage cans affixed thereto and with a portion of the stripper member cut away to allow a view of the can grippers.

Referring now to FIG. 1, there is shown an empty can carrier generally identified by the numeral 10 and comprising the integral combination of a planar carrier board 12 of rigid plastic, a plurality of spaced can grippers 14, and a stripper 16 pivotally hinged to carrier 12 at living hinge 18. Loops 20 and 22 are formed integrally with the carrier 12 and stripper 14, respectively, to provide means by which the device 10 may be hung against a wall or carried. In the illustrated form of the invention, twenty-four grippers 14 extend from the carrier board 12 in a 4×6 array, but it is to be understood that a different number of grippers 14 may be provided in other embodiments. The carrier board 12 and the stripper 16 are both flat and generally rectangular with rounded corners.

Figure 2:
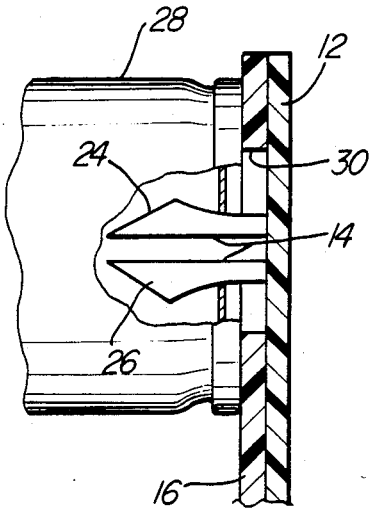
FIG. 2 is a side detail view of the can carrier showing the interaction between the can top and a gripper.

Referring now to FIG. 2, there is shown a side view of the deformable gripper 14. Each gripper 14 comprises two bayonet-type spaced-apart projections 24 and 26 which together resemble an arrowhead and which are dimensioned to be insertable into the opening of a standard beverage can 28. The length of each projection 24,26 is about one inch. At the widest point, the overall width of the projections 24,26 is wider than the can opening; the projections, therefore, flex inwardly toward one another to allow the cans 28 to be affixed and removed. The operation and construction of the grippers 14 is fully disclosed in my U.S. Pat. No. 4,236,638 and the disclosure of that patent is incorporated herein by reference.

It will be noted in FIG. 2 that stripper 16 lies between board 12 and the can tops when in the normal or "home" position. Hence, movement of stripper 16 away from board 12 must pry the cans 28 off of the grippers 14.

Figure 3:
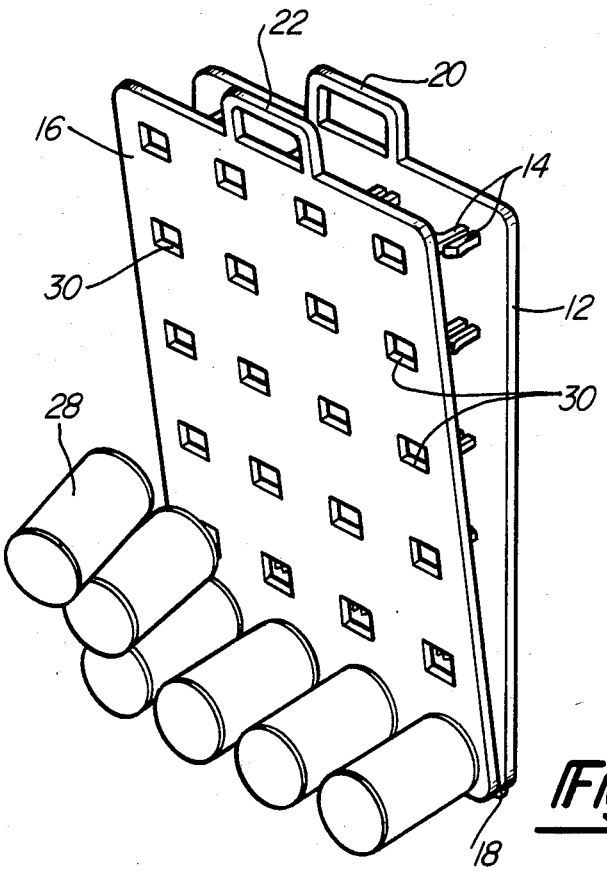
FIG. 3 is a perspective view of the can carrier showing how movement of the stripper plane progressively removes the empty beverage cans from the projections.

Reference is now made to FIG. 3 which depicts operation of the stripper 16. Stripper 16 is pivotally secured to carrier board 12 by means of a living hinge 18. Stripper 16 has deformed therein a plurality of holes 30 which are positioned and sized to fit over grippers 14 when stripper 16 is positioned flush against carrier board 12 in the home position. Holes 30 are also smaller than the top area of the standard 12-ounce beverage can 28.

In the storage mode, stripper 16 is positioned flush against carrier board 12 and is thus interposed between carrier board 12 and cans 28 as the cans are inserted upon grippers 14. During the disengaging operation, handle 22 of stripper 16 is moved away from handle 20 of carrier board 12, causing stripper 16 to detach progressively cans 28 from grippers 14 in horizontal rows starting from the top of device 10.

The carrier 10 is preferably formed of a plastic material which is substantially rigid, yet having sufficient flexibility to allow deformation of the projections. The plastic material must also be elastic to accommodate reuse of the can carrier. The can carrier will preferably be formed in one piece by an injection molding process to minimize the unit cost of the device. Hinge 18 is preferably formed as a living hinge commonly known to the manufacture of plastic materials.

It is recognized that many modifications of this device may be made in the dimensions, structure of the carrier body and stripper plane, and configuration of the projections and hanger/handle means without departing from the spirit of the invention.

The embodiments of the present invention in which an exclusive property or privilege are claimed are defined as follows:

1. An apparatus for storing and carrying empty beverage cans comprising:

a carrier body having a working surface;

a plurality of elastically deformable grippers attached to and projecting outwardly from said surface for holding empty beverage cans; and stripper means pivotally secured to said body in proximate and conforming relation to said surface to lie mediate said surface and said can when in a home position;

whereby movement of said stripper means away from said surface removes said can from said grippers.

2. The apparatus of claim 1 wherein said carrier body includes a handle.

3. The apparatus of claim 2 wherein said stripper means includes a handle which lies adjacent the handle of said body when adjacent the stripper means.

4. The apparatus of claim 1 wherein said apparatus is made of molded plastic.

5. The apparatus of claim 1 wherein said stripper means is movably secured to said carrier body by a living hinge.

6. The apparatus of claim 1 wherein said carrier body and said stripper means are rectangular in shape.

7. The apparatus of claim 6 wherein said carrier body and said stripper means have rounded corners.

8. The apparatus of claim 1 wherein each of said grippers is substantially in the shape of an arrowhead having:

a length sufficient to enter into a beverage can;

an angular leading surface for guiding a can opening over said projection and for acting as a cam to compress the projection during engagement;

a shoulder point wider than a beverage can opening at the end of said angular leading surface for retaining the beverage can;

a concave surface tapered from said shoulder point to a point at which the projection is connected to said carrier body to act as a cam to compress the projection during disengagement of said can from said projection; and a vertical slot through the center of said projection from the tip of the projection to the carrier body for facilitating the compression of the projection.

9. The apparatus of claim 1 wherein said grippers are arranged in a 4×6 rectangular matrix on said working surface of said carrier body, said grippers being spaced apart by a distance at least as great as the diameter of a standard 12-ounce beverage can.

10. The apparatus of claim 1 wherein said grippers are bayonet-type, flexible projections which enter into the open top of a beverage can to hold said can.

* * * * *